US006100632A

United States Patent [19]

Iida

[11] Patent Number: 6,100,632

[45] Date of Patent: Aug. 8, 2000

[54] COLOR CATHODE RAY TUBE AND FABRICATION METHOD OF FLUORESCENT SURFACE THEREOF

[75] Inventor: Keisuke Iida, Omiya, Japan

[73] Assignee: Kabushiki Kaisha Toshiba, Kawasaki, Japan

[21] Appl. No.: 09/031,708

[22] Filed: Feb. 27, 1998

[30] Foreign Application Priority Data

Feb. 28, 1997 [JP] Japan ..... 9-046320

[51] Int. Cl.[7] ..... H01J 29/10

[52] U.S. Cl. ..... 313/461; 313/473

[58] Field of Search ..... 313/461, 463, 313/466, 473, 111, 112

[56] References Cited

U.S. PATENT DOCUMENTS 4,757,231 7/1988 Kato et al. ..... 313/461

FOREIGN PATENT DOCUMENTS 9-17351 1/1997 Japan .

9-288972 11/1997 Japan .

*Primary Examiner*—Vip Patel

*Attorney, Agent, or Firm*—Pillsbury Madison & Sutro LLP

[57] ABSTRACT

A color cathode ray tube is disclosed, that comprises an optical filter layer 2 formed on an inner surface of a glass panel 1, a thin film formed on a front surface of the optical filter layer 2 and composed of a metal oxide, and a fluorescent substance layer 4 formed on the thin film 3 corresponding to a pattern of the optical filter layer 2. The surface state of the thin film 3 is rougher than the surface state of the optical filter layer 2 and similar to the surface state of the fluorescent substance layer 4. Thus, the optical filter layer 2 sparsely contacts the fluorescent substance layer 4. Thus, the influence of the optical filter layer 2 to the fluorescent substance layer 4 can be reduced. Consequently, fluorescent substance particles of the fluorescent substance layer 4 can be suppressed from breaking, dropping, and so forth. Thus, an excellent fluorescent surface can be obtained at high throughput.

4 Claims, 1 Drawing Sheet

COLOR CATHODE RAY TUBE AND FABRICATION METHOD OF FLUORESCENT SURFACE THEREOF

BACKGROUND OF THE INVENTION

1. Field of the Invention

The present invention relates to a color cathode ray tube having a fluorescent surface with an optical filter and a fabrication method thereof.

2. Description of the Related Art

Many color cathode ray tubes that are conventionally used each have an optical filter layer disposed between a glass panel and a fluorescent substance layer so as to improve the brightness and contrast of the fluorescent surface. The fluorescent surface is composed of an optical filter layer and a fluorescent substance layer. The optical filter layer is formed on an inner surface of the glass panel that has a black matrix pattern or a black stripe pattern that has portions that transmit rays of light with wavelengths red, green, and blue. The fluorescent substance layer has portions that emit rays of light of red, green, and blue.

On the fluorescent surface, a fluorescent substance is directly formed on the optical filter layer composed of very fine particles. Thus, the fluorescent substance layer closely contacts the optical filter layer. Consequently, the fluorescent substance layer tends to be affected by the optical filter layer. Thus, fluorescent substance particles tend to reside at different color dots. In addition, on the fluorescence surface, the optical filter layer does not sufficiently adhere to the fluorescent substance layer. Consequently, fluorescent substance particles may break and drop.

SUMMARY OF THE INVENTION

An object of the present invention is to provide a color cathode ray tube having a high-quality fluorescent surface almost free of residual fluorescent substance particles, breaking and dropping thereof, and peeling of the optical filter layer.

Another object of the present invention is to provide a fabrication method of such a fluorescent surface at high throughput.

To accomplish such objects, a first aspect of the present invention is a color cathode ray tube, comprising a panel, an optical filter layer, formed on an inner surface of the panel, having a predetermined pattern, a thin film formed on the optical filter and composed of a metal oxide, and a fluorescent substance layer formed on the thin film corresponding to the pattern of the optical filter layer.

In other words, the feature of the color cathode ray tube according to the present invention is in that a thin film composed of a metal oxide (hereinafter referred to as a metal oxide thin film) is disposed between an optical filter layer and a fluorescent substance layer on a fluorescent surface. Since the surface state of the metal oxide thin film is rougher than the optical filter layer and similar to the surface state of the fluorescent substance layer, the metal oxide thin film allows the surface contact between the optical filter layer and the fluorescent substance layer to be sparse. Thus, the fluorescent substance layer can be less affected by the optical filter layer. Consequently, the residual fluorescent substance particles can be suppressed. In addition, since the adhesion strength of the fluorescent substance layer increases, the fluorescent substance particles are prevented from breaking, dropping, and so forth. Moreover, since the optical filter layer is covered with the metal oxide thin film, the adhesion between the panel surface strongly and the filter layer becomes strong, thereby preventing the optical filter layer from peeling off.

A second aspect of the present invention is a fabrication method of a fluorescent surface of a color cathode ray tube, comprising the steps of forming a pattern of an optical filter layer on an inner surface of a panel, forming a thin film composed of a metal oxide on a front surface of the optical filter layer, and forming a fluorescent substance layer on a front surface of the thin film corresponding to the pattern of the optical filter layer.

In the fabrication method according to the present invention, a suspension of which the pH of a sulfate solution of Al or Zn was adjusted to 7.0 to 7.5 by a diluted ammonia solution is coated on the front surface of the optical filter layer and then dried, the optical filter layer being baked at a temperature ranging from 150° C. to 200° C. Thus, a metal oxide thin film that is dense and uniform is stably obtained. Consequently, a more secure effect can be achieved.

These and other objects, features and advantages of the present invention will become more apparent in light of the following detailed description of a best mode embodiment thereof, as illustrated in the accompanying drawings.

DESCRIPTION OF PREFERRED EMBODIMENT

Figure 1:
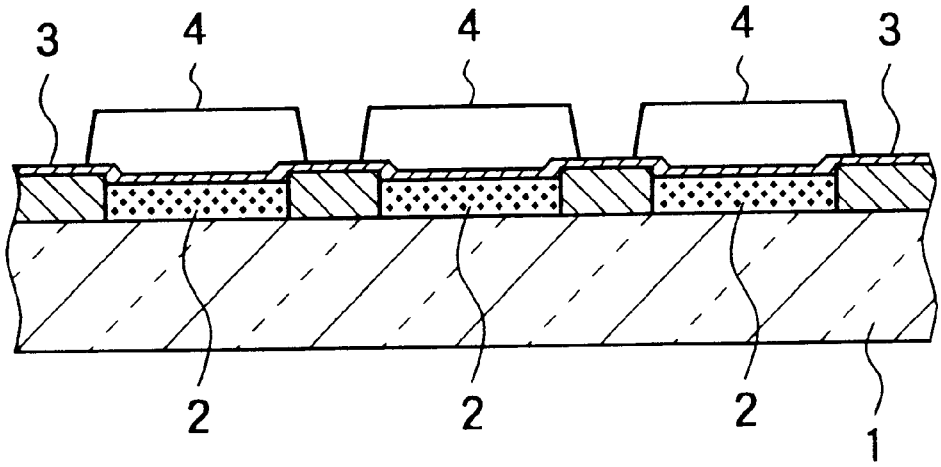
FIG. 1 is a sectional view showing the structure of a fluorescent surface of a color cathode ray tube according to the present invention.

Next, an embodiment of the present invention will be described with reference to the accompanying drawing.

As shown in FIG. 1, a fluorescent surface of a color cathode ray tube according to the present invention comprises a glass panel (face panel) 1, an optical filter layer 2, a thin film 3, and a fluorescent substance layer 4. A black matrix film or a black stripe film is formed on the glass panel 1. The optical filter layer 2 is formed on the inner surface of the glass panel 1. The optical filter layer 2 has portions corresponding to red, green, and blue. The thin film 3 is formed on the front surface of the optical filter layer 2 so that the thin film 3 covers the front surface of the optical filter layer 2. The thin film 3 is composed of a metal oxide. The fluorescent substance layer 4 is formed on the thin film 3 corresponding to the pattern of the optical filter layer 2. The fluorescent surface layer 4 has portions corresponding to red, green, and blue. Thus, the portions corresponding to red, green, and blue of the fluorescent substance layer 4 correspond to the portions corresponding to red, green, and blue of the optical filter layer 2, respectively.

The optical filter layer 2 is composed of a dot pattern or a strip pattern. The dot pattern or strip pattern has portions that transmit rays of light with wavelengths of red, green, and blue corresponding red, green, and blue fluorescent substance portions. As a necessary condition, the metal oxide thin film 3 covers the optical filter layer 2. In other words, it is not necessary to cause the metal oxide thin film 3 to cover the entire surface of the panel including the surface of the optical filter layer 2. However, when the entire panel surface including the surface of the optical filter layer 2 is covered with the metal oxide thin film 3, the adhesion between the optical filter layer 2 and the panel 1 becomes stable.

The surface state of the metal oxide thin film 3 is rougher than the surface state of the optical filter layer 2 and similar to the surface state of the fluorescent substance layer 4. When the metal oxide thin film 3 is formed on the optical filter layer 2, the optical filter layer 2 sparsely contacts the fluorescent substance layer 4. Thus, the influence of the optical filter layer 2 to the fluorescent substance layer 4 can be remarkably decreased. Consequently, fluorescent substance particles can be suppressed from residing. In addition, the adhesion strength of the fluorescent substance layer 4 increases in comparison with the structure of which the fluorescent substance layer 4 directly adheres to the optical filter layer 2. Thus, the fluorescent substance particles are suppressed from breaking, dropping, and so forth.

Example of metals used for the metal oxide thin film 3 are Al, Zn, Ag, Ti, Ca, Sn, Zr.

In other words, one of a variety of metals other than those (such as copper) that react to the fluorescent substance can be used.

For example, the dense metal oxide thin film 3 (composed of Al or Zn) can be fabricated in the following method.

A suspension of which the pH of a sulfate solution of Al or Zn has been adjusted with a dilute ammonia solution is coated on the inner surface of the glass panel 1 with a pattern of the optical filter layer 2 by for example spin coat method. After the resultant glass panel is dried by a heater, it is baked at a temperature of 150° C. to 200° C. in for example two hours. An ammonium sulfate salt as a by-product produced in the baking process can be removed in a rinsing process performed before a first color fluorescent slurry is coated.

The thickness of the metal oxide thin film 3 is preferably in the range from 0.001 $\mu$m to 10 $\mu$m.

The pH of the suspension used in the above-described fabrication method is preferably in the range from 7.0 to 7.5. When the pH of the suspension is lower than 7.0, a hydroxide cannot be sufficiently formed in the suspension. Thus, the desired effect cannot be achieved. In contrast, when the pH of the suspension is higher than 7.5, the particle diameters of metal hydroxide colloid particles become large. Thus, the metal hydroxide colloid particles adhere to the panel surface in the film forming process. Consequently, the optical filter layer may corrode.

The baking temperature is preferably in the range from 150° C. to 200° C. When the baking temperature is lower than 150° C., the hydroxide cannot be sufficiently dehydrated. Thus, the desired effect cannot be achieved. In contrast, when the baking temperature is higher than 200° C., since an organic binder component contained in the optical filter layer is carbonized, the filter film tends to partly drop.

In such a method, the metal oxide thin film 3 that is dense and uniform can be formed on the optical filter layer 2. Since the dense and uniform metal oxide thin film 3 covers the optical filter layer 2, a fluorescent surface of which the optical filter layer 2 stably adheres to the glass panel 1 and the fluorescent substance layer 4 stably adheres to the glass panel 1 can be obtained.

Next, practical examples of fabrication methods of the fluorescent surface of the color cathode ray tube according to the present invention will be described.

EXAMPLE 1

0.4 mol/l of a zinc sulfate solution was diluted by 0.2% of an ammonia solution and thereby a colloid solution of a zinc hydroxide whose pH is 7.2 was obtained. The resultant solution was coated on dot-shaped optical filter layer portions that transmit rays with wavelengths of red, green, and blue by spin coat method. After the optical filter layer was dried, it was baked at 150° C. for two hours. Thus, a zinc oxide thin film was formed. Thereafter, fluorescent slurries for blue, green, and red were coated on the zinc oxide thin film, exposed, and developed. Thus, the fluorescent surface was obtained.

100 color cathode ray tubes (17 inch type) that have such a fluorescent surface each were fabricated. In addition, 100 color cathode ray tubes that do not have a metal oxide thin film each were prepared as comparison objects. With these color cathode ray tubes, film defect points and residual fluorescent substance particles on the fluorescent surfaces were tested. The test results are shown in Table 1.

TABLE 1

| | Dot drop defect | | | Residual particles (Nunber of residual particles on one dot) | | |
|---|---|---|---|---|---|---|
| | Blue (B) | Green (G) | Red (R) | G residual substance particles at R dot | B residual substance particles at R dot | B residual substance particles at G dot |
| Panel with oxide thin film | 2/100 | 0/100 | 1/100 | 0 to 2 | 0 to 3 | 0 to 3 |
| Panel without oxide thin film | 1/100 | 0/100 | 100/100 | 20 to 30 | 10 to 20 | 10 to 20 |

The test results show that the dot drop ratio of the red fluorescent substance on the fluorescent surface that does not have a zinc oxide thin film is 100% and that the dot drop ratio of the red fluorescent substance on the fluorescent surface that has a zinc oxide thin film is 1%. Thus, it is clear that the zinc oxide thin film allows the dot drop ratio of the red fluorescent substance to remarkably improve. In addition, it is clear that the zinc oxide thin film allows the residual ratio of the fluorescent substance particles to remarkably improve.

EXAMPLE 2

0.3 mol/l of a zinc sulfate solution was diluted by 0.2% of an ammonia solution and thereby a colloid solution of a zinc hydroxide whose pH is 7.4 was obtained. The resultant solution was coated on dot-shaped optical filter layer portions that transmit rays with wavelengths of red, green, and blue by spin coat method. After the optical filter layer was dried, it was baked at 190° C. for two hours. Thus, a zinc oxide thin film was formed. Thereafter, fluorescent slurries for blue, green, and red were coated on the zinc oxide thin film, exposed, and developed. Thus, the fluorescent surface was obtained.

100 color cathode ray tubes (17 inch type) that have such a fluorescent surface each were fabricated. In addition, 100 color cathode ray tubes that do not have a metal oxide thin film each were prepared as comparison objects. With these color cathode ray tubes, film defect points and residual fluorescent substance particles on the fluorescent surfaces were tested. The test results are shown in Table 2.

TABLE 2

| | Dot drop defect | | | Residual particles (Nunber of residual particles on one dot) | | |
|---|---|---|---|---|---|---|
| | Blue (B) | Green (G) | Red (R) | G residual substance particles at R dot | B residual substance particles at R dot | B residual substance particles at G dot |
| Panel with oxide thin film | 0/100 | 0/100 | 0/100 | 0 to 2 | 0 to 3 | 0 to 3 |
| Panel without oxide thin film | 1/100 | 0/100 | 100/100 | 20 to 30 | 10 to 20 | 10 to 20 |

The test results show that the dot drop ratio of the red fluorescent substance on the fluorescent surface that does not have a zinc oxide thin film is 100% and that the dot drop ratio of the red fluorescent substance on the fluorescent surface that has a zinc oxide thin film is 0%. Thus, it is clear that the zinc oxide thin film allows the dot drop ratio of the red fluorescent substance to remarkably improve. In addition, it is clear that the zinc oxide thin film allows the residual ratio of the fluorescent substance particles to remarkably improve.

EXAMPLE 3

A colloid solution of a aluminum oxide whose pH is 7.2 was coated on dot-shaped optical filter layer portions that transmit rays with wavelengths of red, green, and blue by spin coat method. After the optical filter layer was dried, it was baked at 160° C. for two hours. Thus, a aluminum oxide thin film was formed. Thereafter, fluorescent slurries for blue, green, and red were coated on the aluminum oxide thin film, exposed, and developed. Thus, the fluorescent surface was obtained.

100 color cathode ray tubes (17 inch type) that have such a fluorescent surface each were fabricated. In addition, 100 color cathode ray tubes that do not have a aluminum oxide thin film each were prepared as comparison objects. With these color cathode ray tubes, film defect points and residual fluorescent substance particles on the fluorescent surfaces were tested. The test results are shown in Table 3.

TABLE 3

| | Dot drop defect | | | Residual particles (Nunber of residual particles on one dot) | | |
|---|---|---|---|---|---|---|
| | Blue (B) | Green (G) | Red (R) | G residual substance particles at R dot | B residual substance particles at R dot | B residual substance particles at G dot |
| Panel with oxide thin film | 1/100 | 0/100 | 1/100 | 0 to 2 | 0 to 3 | 0 to 3 |
| Panel without oxide thin film | 1/100 | 0/100 | 100/100 | 20 to 30 | 10 to 20 | 10 to 20 |

The test results show that the dot drop ratio of the red fluorescent substance on the fluorescent surface that does not have a aluminum oxide thin film is 100% and that the dot drop ratio of the red fluorescent substance on the fluorescent surface that has a aluminum oxide thin film is 1%. Thus, it is clear that the aluminum oxide thin film allows the dot drop ratio of the red fluorescent substance to remarkably improve. In addition, it is clear that the aluminum oxide thin film allows the residual ratio of the fluorescent substance particles to remarkably improve.

EXAMPLE 4

A colloid solution of a aluminum oxide whose pH is 7.3 was coated on dot-shaped optical filter layer portions that transmit rays with wavelengths of red, green, and blue by spin coat method. After the optical filter layer was dried, it was baked at 180° C. for two hours. Thus, a aluminum oxide thin film was formed. Thereafter, fluorescent slurries for blue, green, and red were coated on the aluminum oxide thin film, exposed, and developed. Thus, the fluorescent surface was obtained.

100 color cathode ray tubes (17 inch type) that have such a fluorescent surface each were fabricated. In addition, 100 color cathode ray tubes that do not have a aluminum oxide thin film each were prepared as comparison objects. With these color cathode ray tubes, film defect points and residual fluorescent substance particles on the fluorescent surfaces were tested. The test results are shown in Table 4.

TABLE 4

| | Dot drop defect | | | Residual particles (Nunber of residual particles on one dot) | | |
|---|---|---|---|---|---|---|
| | Blue (B) | Green (G) | Red (R) | G residual substance particles at R dot | B residual substance particles at R dot | B residual substance particles at G dot |
| Panel with oxide thin film | 1/100 | 0/100 | 0/100 | 0 to 2 | 0 to 3 | 0 to 3 |
| Panel without oxide thin film | 0/100 | 0/100 | 100/100 | 20 to 30 | 10 to 20 | 10 to 20 |

The test results show that the dot drop ratio of the red fluorescent substance on the fluorescent surface that does not have a aluminum oxide thin film is 100% and that the dot drop ratio of the red fluorescent substance on the fluorescent surface that has a aluminum oxide thin film is 0%. Thus, it is clear that the aluminum oxide thin film allows the dot drop ratio of the red fluorescent substance to remarkably improve. In addition, it is clear that the aluminum oxide thin film allows the residual ratio of the fluorescent substance particles to remarkably improve.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A color cathode ray tube, comprising:

a panel:

an optical filter layer, formed on an inner surface of said panel, having a predetermined pattern;

a thin film formed on said optical filter and composed of a metal oxide; and a fluorescent substance layer formed on said thin film corresponding to the pattern of said optical filter layer.

2. The color cathode ray tube as set forth in claim 1, wherein the metal of said metal oxide is one of Al, Zn, Ag, Ti, Ca, Sn, Zr.

3. A fabrication method of a fluorescent surface of a color cathode ray tube, comprising the steps of:

forming a pattern of an optical filter layer on an inner surface of a panel;

forming a thin film composed of a metal oxide on a front surface of the optical filter layer; and forming a fluorescent substance layer on a front surface of the thin film corresponding to the pattern of the optical filter layer.

4. The fabrication method as set forth in claim 3, wherein a suspension of which the pH of a sulfate solution of Al or Zn was adjusted to 7.0 to 7.5 by a diluted ammonia solution is coated on the front surface of the optical filter layer and then dried, the optical filter layer being baked at a temperature ranging from 150° C. to 200° C.

* * * * *